United States Patent [19]

Husain

[11] Patent Number: 4,637,137

[45] Date of Patent: Jan. 20, 1987

[54] NAIL CLIPPER

[76] Inventor: Abbas Husain, 5 West Chestnut Ave., Merchantville, N.J. 08109

[21] Appl. No.: 755,913

[22] Filed: Jul. 17, 1985

[51] Int. Cl.[4] ..... A45D 29/02

[52] U.S. Cl. ..... 30/28; 30/27

[58] Field of Search ..... 30/27, 28, 29, 124, 30/134

[56] References Cited

U.S. PATENT DOCUMENTS

| | | | |
|---|---|---|---|
| 450,703 | 4/1891 | Price | 30/28 |
| 846,565 | 3/1907 | Havell | 30/28 |
| 970,067 | 9/1910 | Lieneweber | 30/29 |
| 1,363,164 | 12/1920 | Oesterwitz | 30/28 |
| 2,540,782 | 2/1951 | Hansen | 30/27 |

FOREIGN PATENT DOCUMENTS

| | | | |
|---|---|---|---|
| 582902 | 8/1933 | Fed. Rep. of Germany | 30/28 |

*Primary Examiner*—Jimmy C. Peters

*Attorney, Agent, or Firm*—Muckelroy & Associates

[57] ABSTRACT

Provided is a clipper for a nail made of a pair of cooperative jaws having sharpened edges which register by activating a lever member, the jaws having a normal tendency to separate, the lever member being mounted hingedly and turnably onto a means connecting said jaws for directing a force from said lever member to close said jaws, one of said jaws having a means for spacing said jaw a fixed distance from an interface between a distal part of said nail and skin, another of said jaws having a means for compressing said nail against said means for spacing, each of said jaws having a concave curvature and said jaws also exhibiting respective mating convex and concave edges.

5 Claims, 6 Drawing Figures

NAIL CLIPPER

BACKGROUND OF THE INVENTION

1. Field of the Invention

The novel invention relates to a nail clipper, additionally constituted to provide an extension of a nail at its distal end, said extension being fixed and pre-determined by the dimensions of two integral parts of said clipper.

2. Description of the Prior Art

The following issued patents comprise a portion of the developed pertinent prior art, to wit: U.S. Pat. No. 523,708 issued to La Casse in 1894; U.S. Pat. No. 846,565 issued to Havell in 1907; U.S. Pat. No. 860,975 issued to Havell in 1907; U.S. Pat. No. 775,568 issued to La May in 1904; U.S. Pat. No. 1,085,569 issued to La Casse in 1914; German Pat. No. 582,902 issued to Denk in 1933; British Pat. No. 249,289 issued to Allen in 1926; and U.S. Pat. No. 4,130,937 issued to Kim in 1978.

None of the above cited patent references discloses a construction of a nail clipper similar to or anticipatory of the novel device of the invention described herein.

For example, U.S. Pat. No. 523,708 issued to La Casse teaches only the contouring of a cutting edge for a nail and suggests only that the cutting edge may be suitably varied to conform to the desired form of the nail. La Casse shows only a contouring of the lower edge of a cutting face. In U.S. Pat. No. 775,568 issued to La May concave contouring first disclosed in La Casse is adapted to an upper cutting jaw.

In 1907, in U.S. Pat. No. 846,565 issued to Havell concave contouring of the upper cutting jaw of a nail clipper was used in combination with a downwardly turned sharp edge adapted to cooperate with a seat in the lower jaw of the nail clipper. However, in U.S. Pat. No. 860,975 also issued to Havell also in 1907 only concave contouring of the upper and lower jaws is suggested.

In U.S. Pat. No. 1,085,569 La Casse incorporates a concaved upper cutting edge which is downwardly turned in a concave fashion and adapted to mate with a lower cutting edge and jaw which is shaped in a convex fashion so as to mate with the downwardly turned concave blade of the upper jaw.

British Pat. No. 249,289 to Allen in 1926 discloses a pair of concave mating cutting jaws. The German Pat. No. 582,902 issued to Denk discloses a specific adaptation of the combination of an upper and lower jaw concavely shaped and registered. In addition, the Denk clipper has a downwardly turned cutting blade in the upper jaw and a mating convexed lower cutting blade in the lower jaw.

The drawing in U.S. Pat. No. 4,130,937 issued to Kim suggests that concavely shaped upper and lower jaw members which register constitute an advantageous design without regard to any convolution of the horizontal plane which passes through the juncture of the upper and lower cutting edges.

OBJECTS OF THE INVENTION

It is an object of the invention to provide a clipper for a nail which will permit a user to provide an unattached distal extension of said nail of a pre-determined width.

It is a further object of the invention to provide a nail clipper device suitable for use by physicians to trim ingrown toenails to a pre-determined width.

It is also an object of the novel invention to provide a lever for prying under an ingrown toenail to make the toenail accessible for cutting and yet provide a guard to prevent cutting of the nail at the nail-skin distal juncture.

It is yet another object of the novel invention to provide a nail cutter which provides an optional selection of one of two pre-determined widths for an unattached distal extension of a nail after clipping.

It is yet a further object of the novel invention to provide a clipper for a nail which dissipates the cutting force away from the line of impact made by the cutting edges of the clipper.

SUMMARY OF THE INVENTION

The invention is a novel nail clipper constructed of a conventional upper jaw with an inverted arch shaped concave cutting edge adapted to mate with a conventional lower jaw having a convex, arched cutting edge, each jaw having a mated concave substantially vertical surface wherein the upper jaw has a flange extending orthogonally away from the upper cutting edge yet extending along the entire length of said upper cutting edge and wherein the lower jaw has platform having a width less than the width of said flange, the platform being adapted to fit under a nail and function in conjunction with the flange to grip the nail as it is partially cut into to dissipate the force exerted for cutting.

DESCRIPTION OF THE PREFERRED EMBODIMENT

Figure 1:
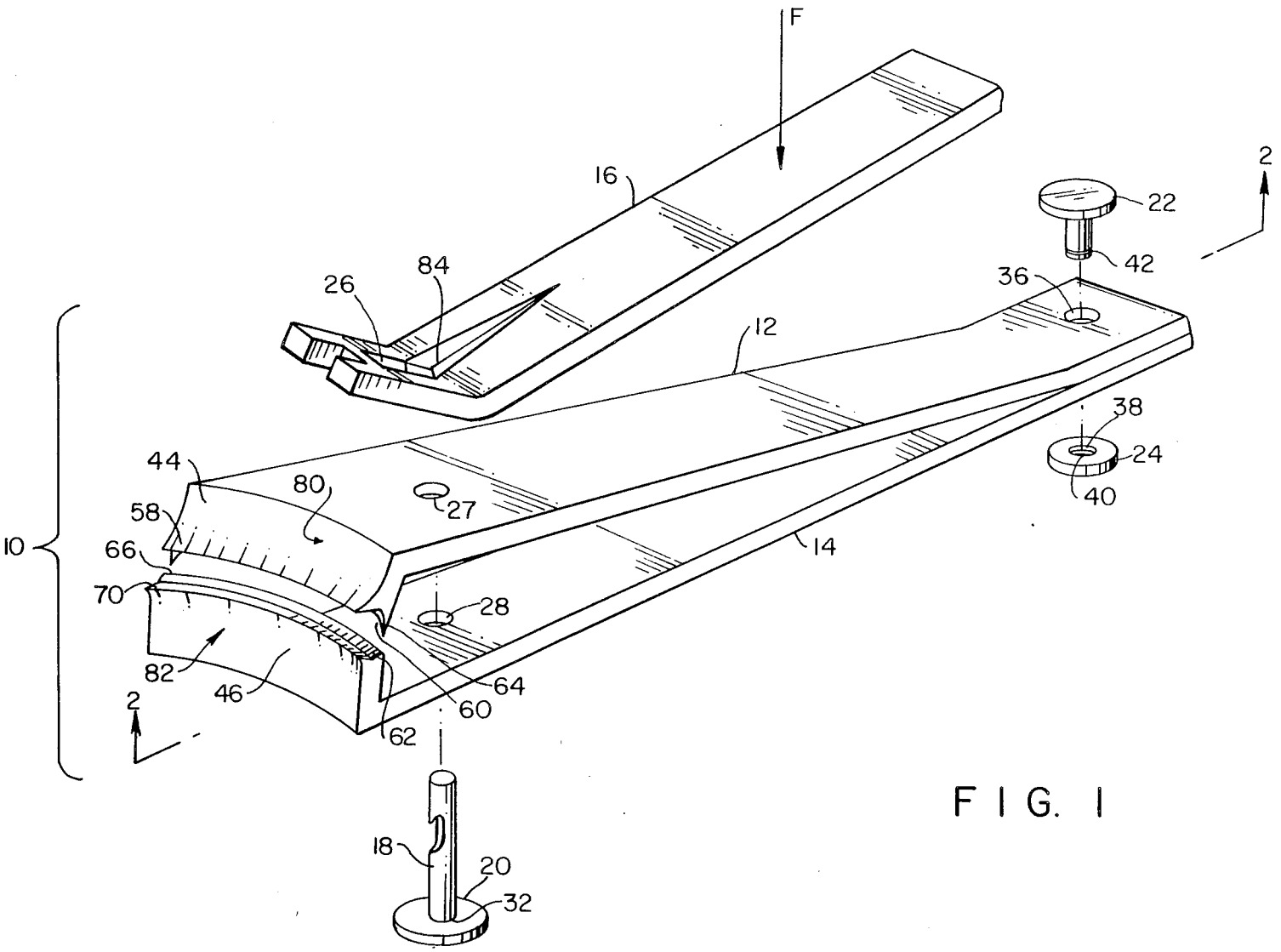
FIG. 1 is an exploded perspective view of the novel nail clipper.

In the drawings, like reference characters designate similar parts in the several views of the invention shown in the drawing.

Referring now to FIG. 1 of the drawings, there is shown a nail clipper 10 in an exploded perspective view. The nail clipper 10, of steel for example, is made of an upper member 12, a lower member 14, a lever member 16, a pivot bolt 18, a pivot nut 20 for said pivot bolt 18, a connecting bolt 22, and a connecting nut 24 for said connecting bolt 22.

Figure 2:
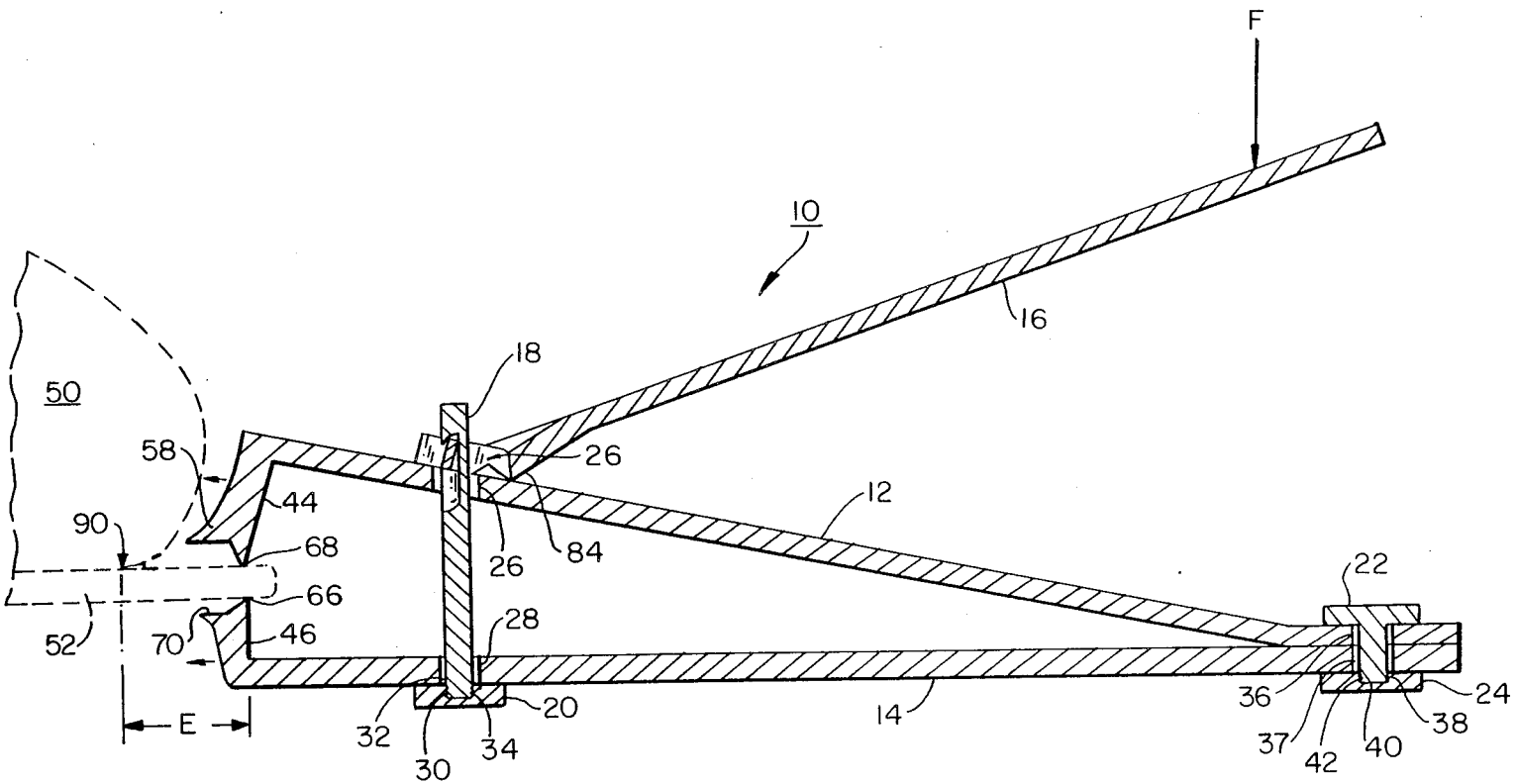
FIG. 2 is a view of an assembled cross-section of the novel nail clipper shown in FIG. 2 taken along the plane 2—2.

The nail clipper 10, shown in FIG. 2, is assembled by inserting the pivot bolt 18 through a hole 26 in the lever member 16, then through a hole 27 in the upper member 12 and then through a hole 28 in the lower member 14. Thereafter, the pivot nut 20 is attached to the pivot bolt 18 by means of threads 30 in a aperture 22 formed in the pivot nut 20. The threads 30 are adapted to mate with threads 34 formed at an end of the pivot bolt 18. Similarly, the connecting bolt 22 is adapted to be inserted through apertures 36 and 37 which extend through the upper member 12 and the lower member 14, respectively. The connecting nut 24 has an aperture 38 with threads 40 therein adapted to mate with and connect to threads 42 formed at an end of the connecting bolt 22.

There is shown in FIG. 2 the nail clipper 10 in cross-section and assembled. As shown, the lever member 16 is adapted to pivot around the pivot pin 18 in either a clockwise or counterclockwise direction. Further, the upper member 12 is adapted with a jaw 44. The lower member 14 is adapted with a jaw 46. The jaws 44 and 46 are normally open and separated from each other. The jaws 44 and 46 are closed by the application of force on the lever 16 along the vector F. Force applied to the lever 16 along the vector F is transferred by the pivot pin 18 to the upper member 12 and the lower member 14. Force transferred to the upper member 12 and lower member 14 is ultimately transferred mechanically to the upper jaw 44 and lower jaw 46.

Figure 3A:
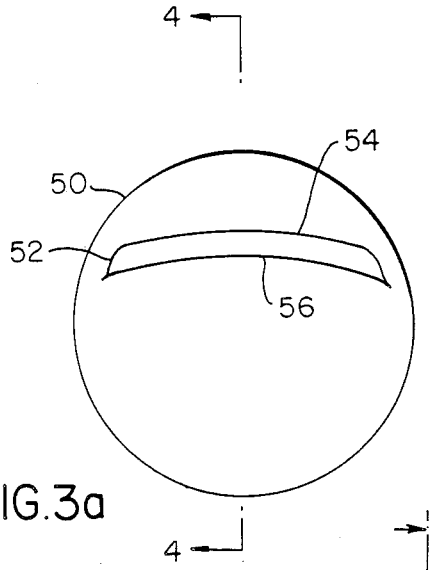
FIG. 3*a* is a frontal view of a distal end of a phalangeal appendage with attached nail.

FIG. 3*a* is a frontal view of the distal end of a phalangeal appendage 50 such as, for example, a toe or a finger with a nail 52 attached. The nail 52 has a dorsal surface 54 and a ventral surface 56. The nail 52 is shown exhibiting an arc of curvature.

Figure 3B:
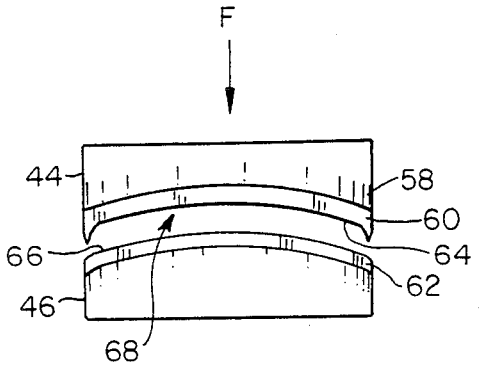
FIG. 3*b* is a frontal view of a pair of jaws for the novel nail clipper.

There is shown in FIG. 3*b* a front view of the jaw 44 and a front view of the jaw 46. Also shown is a front view of a flange 58 integrally attached to the upper jaw 44 and extending along the upper jaw 44 above an upper cutting surface 60 of the upper jaw 44. The flange 58 also orthogonally tapers away from the upper and lower jaws 44 and 46. The flange 58 exhibits an arc of curvature similar to that exhibited by the nail 52 shown in FIG. 3*a*. There is also shown in FIG. 3*b* a lower cutting surface 62 which exhibits a convex or inverted arc of curvature. The lower cutting surface 62 is attached to the lower jaw 46. The upper cutting surface 60 has an edge 64 which, from the front view shown in FIG. 3*b*, exhibits a downwardly turned concaved curvature with fang-like ends which are an integral part of the upper jaw 44. The curvature of the edge 64 is adapted to register and mate with the curvature of the lower cutting surface 62. The lower cutting surface 62 has an edge 66 which is convexed.

Figure 4A:
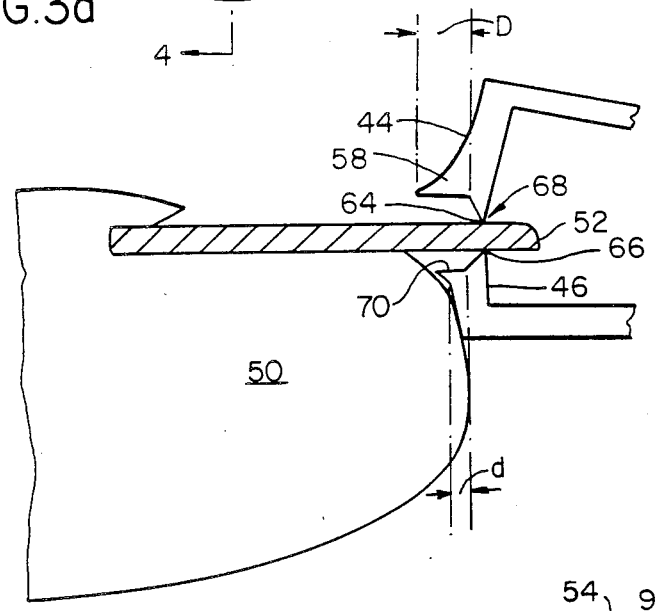
FIG. 4*a* is a view of a cross-section of the appendage shown in FIG. 3*a* taken along the plane 4—4 in conjunction with a segment of the cross-section of the novel nail clipper shown in FIG. 1; and, FIG. 4*b* is a view of a cross-section of the appendage shown in FIG. 3*a* taken along the plane 4—4 in conjunction with the segment of the cross-section of the novel invention shown in FIG. 4*a* showing a pair of cutting jaws closed on a nail.

The nail 52 in FIG. 3*a* is cut or clipped by cooperation between the upper jaw 44 and the lower jaw 46 whereby the upper jaw 44 proximates with the lower jaw 46 upon application of force along the vector F. There is shown in FIG. 4*a* one position of the novel clipper 10 utilized to perform a clipping operation on the nail 52. The nail 52 is shown within a space 68 between the upper jaw 44 and the lower jaw 46. The nail 52 is shown held between the upper cutting edge 64 and the lower cutting edge 66. The flange 58 is shown in FIG. 4*a* in cross-section. Also shown in FIG. 4*a* is a platform 70. The platform 70 extends in a tapered fashion orthogonally away from the upper and lower jaws 44 and 46. The platform 70, an integral part of the lower jaw 46, is specifically designed to have a width d which is approximately 50% of a width D for the flange 58.

Figure 4B:
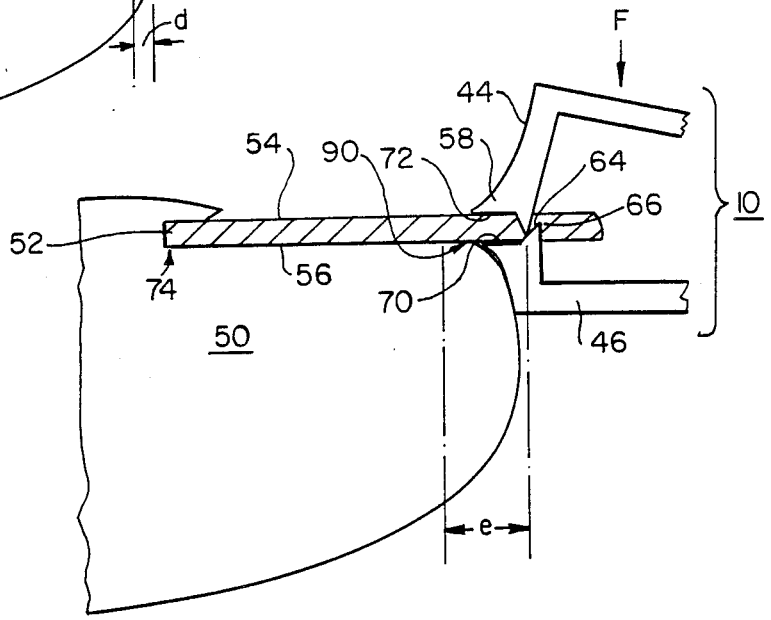

In FIG. 4*b* the upper jaw 44 is shown with the flange 58 making contact with the dorsal surface 54 of the nail 52. The lower jaw 46 is shown with the platform 70 making contact with the ventral surface 56 of the nail 52.

The flange 58 is specifically shown with a ventral surface 72 in contact with the dorsal surface 54 of the nail 52. As force is applied along the vector F, the cutting edges 64 and 66 cut into the nail 52. During this operation, force is transferred from the upper jaw 44 and dissipated along the ventral surface 72 of the flange 58 as well as along the platform 70. This dissipation of force tends to alleviate the clicking sound normally associated with nail clipping and also alleviates substantial bending of the nail 52 during the clipping operation. Further, the transfer of force along the platform 70 and the ventral surface 72 of the flange 58 lessens trauma to the nail-bed at the nail bed juncture 74.

Referring again to FIG. 1, there is shown the flange 58 and the platform 70 in perspective view. Also shown is the cutting edge 64 and the cutting edge 66. Also illustrated is the cutting surface 60 and the cutting surface 62. Both the jaw 44 and the jaw 46 have a substantially concaved curvature as exhibited by the surface 80 of the jaw 44 and the surface 82 of the jaw 46.

The lever member 16 is adapted with a protrusion 84 to provide a levering action when force is applied to the lever member 16 along the vector F.

A unique feature of the novel nail clipper 10 as shown in FIG. 2, is that when the nail clipper 10 shown in FIG. 2 is utilized up-side-down with respect to the appendage 50 and the nail 52 previously described and shown in FIG. 4*a*, the flange 58 provides an optional greater spacing of the cutting edges 66 and 68 away from the appendage 50.

The flange 58, when using the novel nail clipper 10 in the fashion shown in FIG. 2, permits a user to provide an unattached distal extension E for the nail 52 with the distal extension E having a pre-determined width E.

Referring now to FIG. 4*b* and comparing FIG. 4*b* with FIG. 2, it may be observed that utilizing the nail clipper 10 in the fashion shown in FIG. 4*b* permits the user of the nail clipper 10 to provide a smaller unattached distal extension e of the nail 52 with the extension e having a pre-determined width e, for example 1.25 mm. Utilizing the clipper 10 in the fashion shown in FIG. 4*b*, the platform 70 provides and determines the location of the cutting edges 64 and 66 with respect to the nail 52.

The mode of operation and use of the nail clipper 10 and utility of the nail clipper 10, shown in FIG. 2, is specifically adaptable to the clipping and removal of the unattached distal extension of an ingrown toe nail, for example, nail 52.

The nail-skin distal juncture is shown at 90 in FIG. 4*b* and at 90 in FIG. 2. Cutting of the nail 52 at this juncture can cause pain and is a common occurrence with conventional nail cutters. Cutting of the nail 52, for example, with the novel nail cutter 10 prevents cutting of a nail, for example the nail 52, at the nail-skin distal juncture 90.

While the foregoing has illustrated and described what is now contemplated to be the best mode of carrying out the invention, the description is, of course, subject to modifications pursuant to the doctrine of equivalents without departing from the spirit and scope of the invention. Therefore, it is not desired to restrict the invention to the particular construction illustrated and described, but to cover all modifications that may fall within the scope of the invention pursuant to equivalents to the appended claims.

What is claimed is:

1. In a clipper for a nail comprising a combination of a pair of cooperative jaws having a normal tendency to separate, a means for connecting said jaws, said means being located in a pivotal relation with said jaws, an operating member cooperating with said means, a means on said operating member projecting therefrom for proximating said jaws when said operating member is operated in one direction, said pair further comprising an upper jaw and a lower jaw, said upper jaw having an upper sharpened edge, said lower jaw having a lower sharpened edge, said upper edge and said lower edge being adapted to engage each other, said upper and lower edges each having a concave curvature projection upon a horizontal plane and each edge being adapted to substantially conform to a curvature of one end of a human finger in plan view, said upper edge further having a concave curvature projection upon a vertical plane, said lower edge further having a convex curvature projection upon a vertical plane, the improvement comprising:

flange member integrally connected to the upper jaw above said upper edge, said flange member tapering orthogonally away from said edge;

means for supporting a nail located adjacent said lower edge and integrally connected to said lower edge; and, fang-like projections located at each end of said upper jaw in a continuous curvature of said upper cutting edge, said lower cutting surface being adapted to register and mate with said fang-like projections.

2. The clipper of claim 1 wherein said means for supporting a nail is a tapered platform, the tapered platform being adapted to fit under a nail and function in conjunction with the flange member to grip the nail with said fang-like projections, said upper cutting edge being further adapted to cut initially into said nail with said fang-like projections whereby force exerted by the cutting of said nail is dissipated.

3. In a nail clipper comprising a combination of a pair of cooperative jaws having a normal tendency to separate, a means for connecting said jaws, said means being located in a pivotal relation with said jaws, an operating member cooperating with said means, a means on said operating member projecting therefrom for proximating said jaws when said operating member is operated in one direction, said pair further comprising an upper jaw and a lower jaw, said upper jaw having an upper sharpened edge, said lower jaw having a lower sharpened edge, said upper edge and said lower edge being adapted to engage each other, said upper and lower edges each having a concave curvature projection upon a horizontal plane, a means for spacing said lower sharpened edge a fixed distance from an interface between a distal part of said nail and skin a means for supporting a nail located adjacent said lower edge and connected to said lower edge, the improvement comprising:

a means for providing an optional selection of one additional fixed distance from the interface between the distal part of said nail and skin, the last said means being integrally connected to said upper edge whereby the last said means is made available by inverted use of said clipper.

4. In a clipper for a nail having a nail-skin juncture comprising a combination of a pair of cooperative jaws having a normal tendency to separate, a means for connecting said jaws, said means being located in a pivotal relation with said jaws, an operating member cooperating with said means, a means on said operating member projecting therefrom for proximating said jaws when said operating member is operated in one direction, said pair further comprising an upper jaw and a lower jaw, said upper jaw having an upper sharpened edge, said lower jaw having a lower sharpened edge, said upper edge and said lower edge being adapted to engage each other, the improvement comprising:

a flange means for pressing said nail connected to the upper jaw above said upper edge, said flange means for pressing tapering orthogonally away from said edge, said flange means for pressing having a first width;

a platform means for supporting said nail located adjacent said lower edge and connected to said lower edge, said platform means tapering away from said lower edge and having a second width less than said first width and wherein the platform means and the flange means are each adapted to fit under the nail and space said cutting edges a predetermined distance away from said nail-skin distal juncture.

5. The clipper of claim 4 wherein said flange means, upon inversion of the clipper, determines the location of each cutting edge in relationship to the nail-skin distal juncture.

* * * * *